US005193981A

United States Patent [19]

Scheidel et al.

[11] Patent Number: 5,193,981

[45] Date of Patent: Mar. 16, 1993

[54] FAN WHEEL WITH CUP SHAPED HUB

[75] Inventors: Wolfgang Scheidel, Buehl; Reuben Agnon, Sasbach, both of Fed. Rep. of Germany

[73] Assignee: Robert Bosch GmbH, Stuttgart, Fed. Rep. of Germany

[21] Appl. No.: 806,883

[22] Filed: Dec. 12, 1991

[30] Foreign Application Priority Data

Jan. 25, 1991 [DE] Fed. Rep. of Germany ..... 4102161

[51] Int. Cl.[5] ..... F04D 29/38

[52] U.S. Cl. ..... 416/179; 416/169 A; 416/245 R

[58] Field of Search ..... 416/169 A, 179, 189, 416/244 R, 245 R

[56] References Cited

U.S. PATENT DOCUMENTS

| | | | |
|---|---|---|---|
| D. 206,695 | 1/1967 | Dickinson | 416/245 |
| 2,030,993 | 2/1936 | Langenkamp et al. | 416/169 A |
| 3,819,294 | 6/1974 | Honnold et al. | 416/245 |
| 3,993,415 | 11/1976 | Hauser | 416/245 |
| 4,373,861 | 2/1983 | Papst et al. | 416/245 |
| 4,684,324 | 8/1987 | Perosino | 416/189 |
| 4,695,513 | 8/1987 | Longhouse et al. | 416/189 |

*Primary Examiner*—John T. Kwon
*Attorney, Agent, or Firm*—Michael J. Striker

[57] ABSTRACT

A fan wheel has a cup shaped hub having an outer cup wall with a plurality of vanes and a cup bottom connectable with a shaft of a drive and provided at its inner side with a plurality of ribs defining a plurality of fields therebetween. The cup bottom in the region of the fields has a plurality of depressions extending from its inner side and having a width approximately 70% of a thickness of the cup bottom.

7 Claims, 2 Drawing Sheets

FAN WHEEL WITH CUP SHAPED HUB

BACKGROUND OF THE INVENTION

The present invention relates to a fan wheel with a cup shaped hub with a cup wall provided with a plurality of radially extending vanes and a cup bottom connected with a shaft of a drive motor.

Fan wheels of the above mentioned general type are known in the art. In a known fan wheel the cup bottom has substantially the same thickness as the cup wall. When such a fan wheel is fixedly connected with the shaft of the drive motor, the magnetic force fluctuations occurring in the electric motor due to the armature grooves extending through the magnetic field can propagate through the shaft to the hub and radiated through the vanes as sound transmitted air. The flutes tone produced in this way has a frequency of approximately 630 Hz depending on the size of the hub and is disturbing especially when the fan is used for ventilation of the cooling device for the internal combustion engine of a motor vehicle.

SUMMARY OF THE INVENTION

Accordingly, it is an object of the present invention to provide a fan wheel which avoids the disadvantages of the prior art.

In keeping with these objects and with others which will become apparent hereinafter, one feature of the present invention resides, briefly stated, in a fan wheel which has a cup shaped hub with a plurality of ribs provided on its cup bottom and defining fields therebetween, wherein in accordance with the present invention the cup bottom in the region of the above mentioned fields has depressions extending from their inner side and having a depth corresponding to at least 70% of the thickness of the cup bottom.

When the fan wheel is designed in accordance with the present invention it avoids the disadvantage of the prior art.

The fan wheel in accordance with the present invention in the regions of the field and therefore the vibrations in this region are eliminated. Thereby the disturbing operational noise disappears.

The frequency f, for example 630 Hz, is calculated as follows:

$$f=Z\cdot n/60$$

wherein Z is a number of the grooves, n is a rotary speed in revolutions per minute.

The passing wavelength $$\lambda=c/f$$

c is the speed of sound in m/s. Here $$\lambda=340\ m/s/360\ Hz=0.54\ m.$$

This equation takes place when the half diameter $$D=\lambda/4.\ \text{Here:}$$

$$D=0.54\ m/4=0.135\ \text{m}.$$

Since the motor size and the fan size cannot be changed (required values for performing the objective), therefore with these features the hub is determined acoustically or in other words made acoustically "soft".

In accordance with another feature of the present invention the depressions, as seen in the circumferential direction of the hub, extend from one rib to another neighboring rib.

In accordance with still a further feature of the present invention, the fields between the neighboring ribs are provided with throughgoing openings. Preferably, the throughgoing openings extend in a radial direction and are slot-shaped.

The width of the slots measured in the circumferential direction of the hub can amount to maximum 3 mm.

Finally the free ends of the vanes are connected without another by a ring which surrounds the hub.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
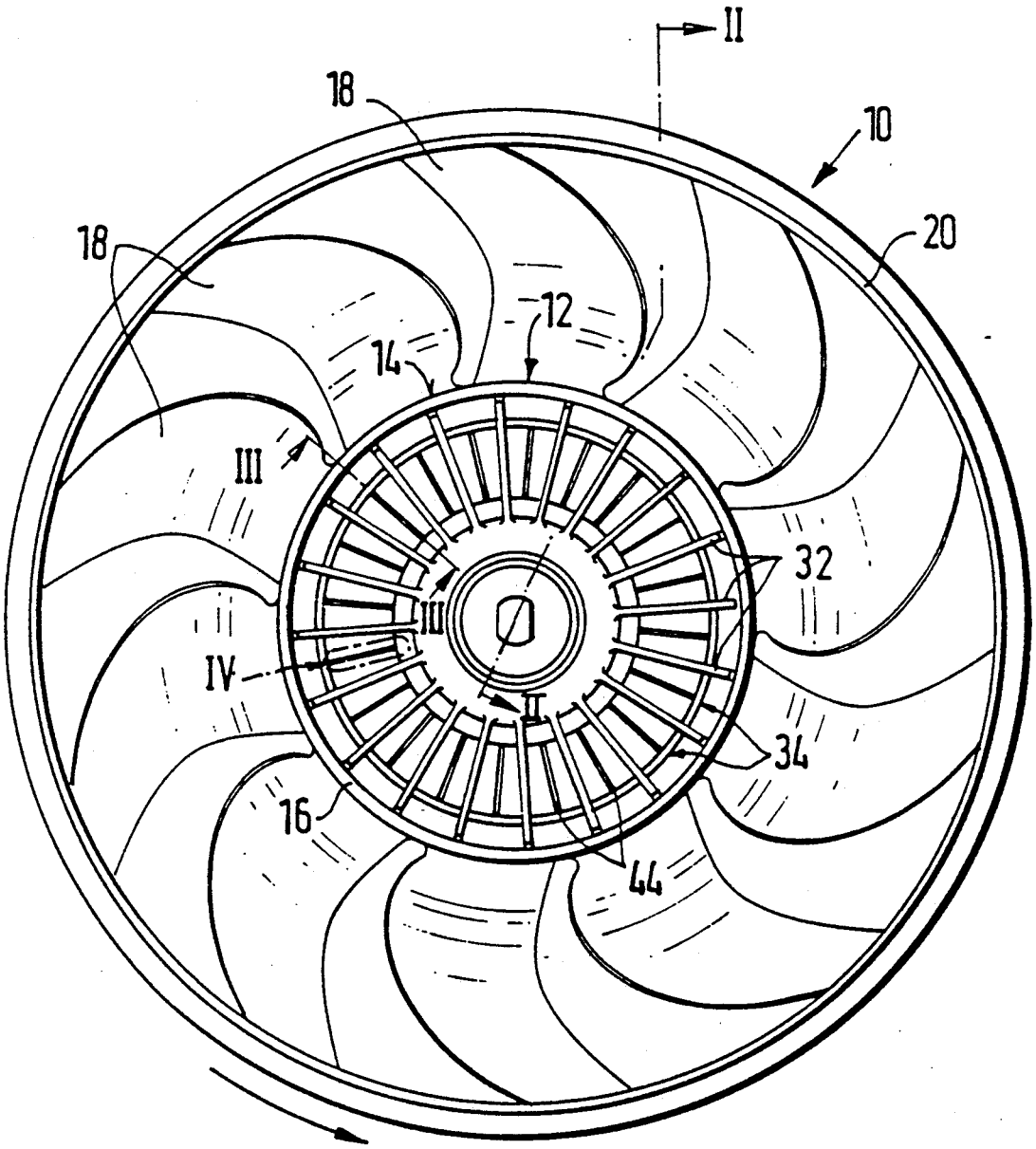
FIG. 1 is a plan view showing a fan wheel in accordance with the present invention with a cup shaped hub.

A fan wheel in accordance with the present invention is identified as a whole with reference 10 in FIG. 1. It has a cup shaped hub 20 clearly shown in FIG. 2.

The hub 12 has a cup wall 16 provided with a plurality of vanes 18 on its outer side 14. The vanes 18 are connected on their free ends by a circular ring 20. A cup bottom 22 is connected with a ring shaped wall 14 and extends in a radial direction of the fan wheel 10. A greater part of an electrical drive motor 24 is accommodated in the cup 12. It is shown in FIG. 2 in dash-dot lines and identified with reference numeral 24.

The electric drive motor 22 has a drive or armature shaft 26 extending from it. The cup bottom 22 of the cup 12 of the fan wheel 10 is mounted on the free end of the shaft 26. For this purpose the shaft 26 extends through the cup bottom to the region of a central reinforcement 28. The mounting is performed by a mounting nut 30 which is screwed on a not shown threaded pin of the armature shaft 26. Thereby the hub 12 and therefore the fan wheel 10 is fixedly connected with the shaft 26 and the fan wheel rotates together with the not shown armature of the electric motor 24.

Figure 2:
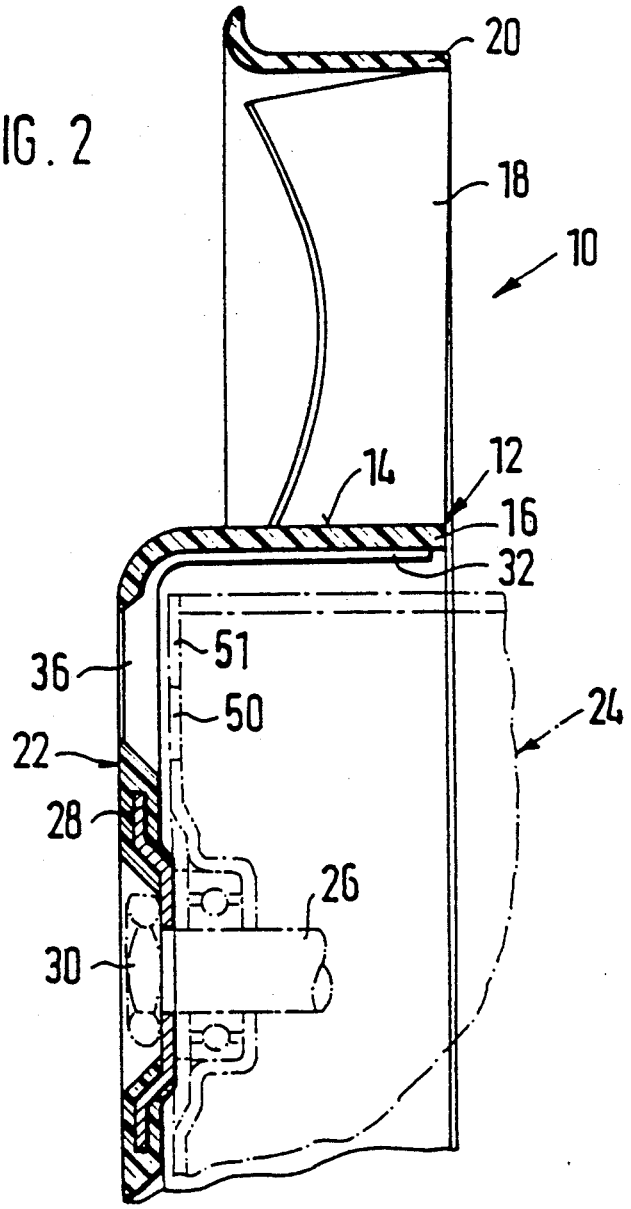
FIG. 2 is a view showing a partial section through the inventive fan wheel taken along the line II—II in FIG. 1 on an enlarged scale.

As shown in FIG. 2, the cup shape hub 12 is provided with ribs 32 on its inner side, both in the region of the inner wall of the cup as well extending in the region of the cup bottom 22. As seen in the circumferential direction of the hub, they are arranged at a distance from one another and extend radially on the cup bottom 22 as can be seen in FIG. 1. Fields 34 of the cup bottom 22 is formed between neighboring ribs 32. The fields have substantially the shape of the segments which, when seen in FIG. 1 shown in the cup shape of the hub 12. As can be seen from FIG. 2, the cup bottom in the region of the field 34 has depressions 36 extending from its inner side. The depressions 36 have a depth 38 at least equal to 70% of the thickness 40 of the cup bottom as shown in FIG. 3.

Figure 3:
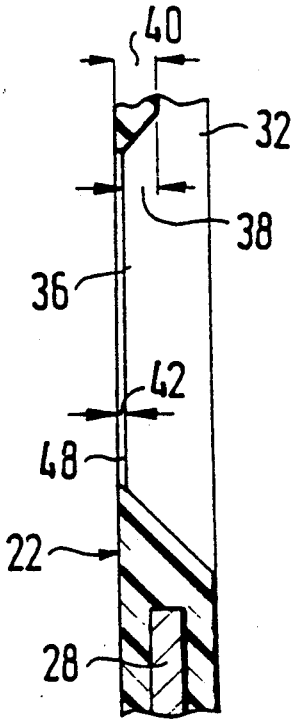
FIG. 3 is a partial section through the fan wheel in accordance with the present invention taken along the line III—III on an enlarged scale.

As can be also seen from FIG. 3 that a remaining thickness 42 of the cup bottom 22 in the region of the depressions 36, as compared with the ribs 32, is very small. Therefore a certain elasticity of the fan wheel in the region of the bottom 22 is produced. As a result, a tendency to vibrations is obtained. Furthermore, the hub is thereby determined acoustically. As shown in FIG. 1, the depressions 36 extend between the ribs 32 over the whole distance between two neighboring ribs 32. As can also be seen from FIG. 1, the fields 34 between the neighboring ribs 32 have through-going passages 44. The passages 44 are preferably radial and slot shaped.

Figure 4:
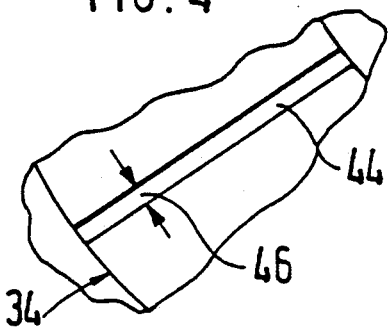
FIG. 4 is a view showing a fragment of FIG. 2 identified with IV on an enlarged scale.

The slots 44 have a maximum width 46 equal to 3 mm as considered in the circumferential direction of the hub 12. This is shown in FIG. 4. The slots, with the remaining thin wall 38 in the region of the fields 34, must form a reliably protection against spring water from the outer side of the cup bottom 22. In the event of excessively wide slots 44 it can penetrate through cooling air opening 50 in the end wall 51 of the electric drive motor 24 which faces the cup bottom 22. The spring water can whirl through the motor vehicle from the street. The ventilating device with the fan wheel 10 can be used for the ventilation of the cooling device of an internal combustion engine of a motor vehicle. Due to the rotatable fan wheel, in connection with the low width of the slots 44, it is reliably prevented that the spray water flows through the ventilating openings 50 into the electric motor 22 and can damage it.

It will be understood that each of the elements described above, or two or more together, may also find a useful application in other types of constructions differing from the types described above.

While the invention has been illustrated and described as embodied in a fan wheel, it is not intended to be limited to the details shown, since various modifications and structural changes may be made without departing is any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims.

1. A fan wheel, comprising a cup shaped hub having an outer cup wall with a plurality of vanes, and a cup bottom connectable with a shaft of a drive and provided at its inner side with a plurality of ribs defining a plurality of fields therebetween, said cup bottom in the region of said fields having a plurality of depressions extending from its inner side and having a width approximately 70% of a thickness of said cup bottom.

2. A fan wheel as defined in claim 1, wherein said vanes of said cup wall extend in a radial direction, said ribs of said cup bottom extending in a radial direction.

3. A fan wheel as defined in claim 1, wherein said depressions, extend from one of said ribs to a neighboring one of said ribs in a circumferential direction of the hub all the way.

4. A fan wheel as defined in claim 1, wherein said fields between two neighboring ones of said ribs have slots-shaped throughgoing passages.

5. A fan wheel as defined in claim 4, wherein said slot-shaped throughgoing passages extend in a radial direction.

6. A fan wheel as defined in claim 4, wherein said slot-shaped throughgoing passages have a width of at most 3 mm.

7. A fan wheel as defined in claim 1, wherein said vanes have free ends; and further comprising a ring which surrounds the hub and connects said free ends of said vanes with one another.

* * * * *